United States Patent [19]

Martin

[11] 4,013,223

[45] Mar. 22, 1977

[54] FUEL INJECTION NOZZLE ARRANGEMENT

[75] Inventor: Barrie James Martin, Shenfield, England

[73] Assignee: Plessey Handel und Investments A.G., Zug, Switzerland

[22] Filed: July 15, 1975

[21] Appl. No.: 596,205

[30] Foreign Application Priority Data

July 16, 1974 United Kingdom ..... 31549/74

[52] U.S. Cl. ..... 239/102; 239/571; 261/DIG. 48; 261/81

[51] Int. Cl.[2] ..... B05B 17/06

[58] Field of Search ..... 261/DIG. 48, 66, 81, 261/1; 239/102, 571

[56] References Cited

UNITED STATES PATENTS

| | | | |
|---|---|---|---|
| 1,967,970 | 7/1934 | Palmer | 239/571 |
| 2,908,443 | 10/1959 | Fruengel | 261/DIG. 48 |
| 3,194,162 | 7/1965 | Williams | 239/102 |
| 3,329,412 | 7/1967 | Knappett | 261/50 R |
| 3,720,403 | 3/1973 | Winquist et al. | 261/50 A |
| 3,819,116 | 6/1974 | Goodinge et al. | 239/102 |
| 3,884,417 | 5/1975 | Sheffield et al. | 239/102 |

*Primary Examiner*—Tim R. Miles
*Attorney, Agent, or Firm*—Fleit & Jacobson

[57] ABSTRACT

A fuel injection nozzle arrangement comprising a fuel injection nozzle having a fuel injection orifice, and vibratory means such as a piezoelectric crystal for vibrating the nozzle to cause atomization of fuel ejected from the nozzle through the orifice, the nozzle having a fuel-retaining valve at the fuel inlet side of the orifice arranged to normally close the orifice and thus prevent the injection of fuel but to be opened when the vibratory means is energised to permit injection of fuel, and the nozzle having a gas-excluding valve at the fuel outlet side of the orifice arranged to normally close the orifice and thus prevent the entry of gases into the nozzle through the orifice but to open under fuel injection pressure to permit the injection of fuel.

7 Claims, 4 Drawing Figures

FUEL INJECTION NOZZLE ARRANGEMENT

This invention relates to a fuel injection nozzle arrangement.

It is an object of the present invention to prevent the possibility of gases which are external to a fuel injection nozzle arrangement from entering the fuel injection nozzle.

Accordingly, this invention provides a fuel injection nozzle arrangement comprising a fuel injection nozzle having a fuel injecting orifice, and vibratory means for vibrating the nozzle to cause atomization of fuel ejected from the nozzle through the orifice, the nozzle having a fuel-retaining valve at the fuel inlet side of the orifice arranged to normally close the orifice and thus prevent the injection of fuel but to be opened when the vibratory means is energised to permit injection of fuel, and the nozzle having a gas-excluding valve at the fuel outlet side of the orifice arranged to normally close the orifice and thus prevent the entry of gases into the nozzle through the orifice but to open under fuel injection pressure to permit the injection of fuel and the fuel-retaining valve being situated in a housing in the nozzle and the housing having at least one aperture at a position where the valve will tend to move when the vibratory means is activated thereby to allow fuel to enter the housing through this aperture and force the fuel-retaining valve towards the orifice when the nozzle is not being vibrated.

Preferably the gas-excluding valve is arranged to normally close the orifice by means of a spring retainer. The spring retainer acts mainly to maintain the gas excluding valve in the vicinity of the nozzle orifice when fuel injection is taking place and the gas excluding valve is forced off the orifice. It will thus be appreciated that a relatively soft leaf spring arrangement may be employed if desired.

Preferably, one end of the spring retainer is attached to the gas excluding valve and the other end of the spring retainer is attached to means remote from the nozzle thereby to avoid increasing the mass of the nozzle. The means remote from the nozzle may be, for example, a cylinder wall of an internal combustion engine. In some circumstances it may not be possible to attach the other end of the spring retainer to means remote from the nozzle and in this case the said other end of the spring retainer may be fixed to the nozzle tip.

Preferably, the gas-excluding valve is a ball valve although other types of valve may be employed if desired.

The vibratory means may include a piezoelectric device.

The fuel injection nozzle will either be vibrated with so-called "ultrasonic vibrations" or at so-called "ultrasonic frequency". These vibrations are obviously sufficient to cause the fuel to disintegrate into small mist-like particles. The frequency range in question may, in practice, be found to have its lower limit somewhere near the upper limits of audibility to a human ear. However, for reasons of noise suppression, it is generally preferable in practice to use frequencies high enough to ensure that audible sound is not produced.

Embodiments of the invention will now be described by way of example and with reference to the accompanying drawings, in which.

Figure 1:
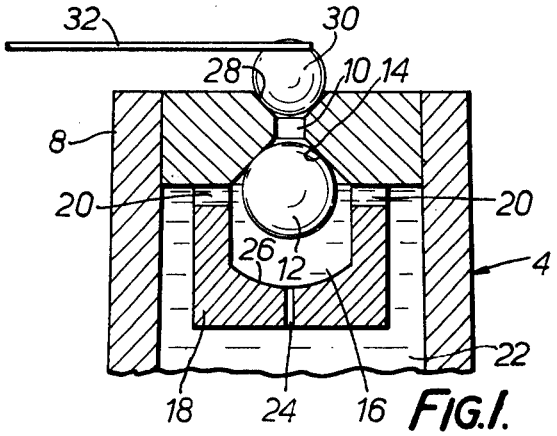
FIG. 1 is a cross-section through a fuel injection nozzle tip forming part of a fuel injection nozzle arrangement in accordance with the present invention.
Figure 2:
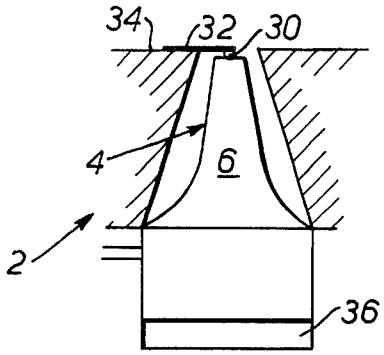
FIG. 2 shows a fuel injection nozzle arrangement in accordance with the invention and one that may employ a fuel injection nozzle tip as illustrated in FIG. 1.

Referring to FIGS. 1 and 2, there is shown a fuel injection nozzle arrangement 2 comprising a fuel injection nozzle 4 having an amplifying horn portion 6. The nozzle 4 has an end tip shown most clearly in FIG. 1 and it will be seen that this nozzle tip comprises a housing 8 having a fuel injection orifice 10 therein. A fuel retaining valve in the form of a ball valve 12 seats against a valve seat 14 defining the inlet side of the orifice 10.

The ball valve 12 is present in a swirl chamber 16 formed in a housing 18. The housing 18 is provided with swirl slots 20 which allow fuel to pass along a central conduit 22 and into the fuel swirl chamber 16. The housing 18 is also provided with a further conduit 24 which ensures that if, during vibratory periods, the ball valve 12 comes off its seat 14 and rests against the rear wall 26 of the housing 18, then fuel passing along the passage 24 will tend to speedily force the ball valve 12 off the rear wall 26 when the vibration is stopped to enable the fuel in the swirl chamber 16 to speedily force the ball valve back to its valve seat 14, thereby quickly shutting off the fuel injection. The feature of the housing 18 and the passage 24 is more precisely illustrated and claimed in co-pending U.S. patent application Ser. No. 549,306 entitled "Improvements in or relating to fuel atomizers".

The housing 8 of the fuel injection nozzle 4 is provided with a further valve seat 28 which receives a gas-excluding valve in the form of a ball valve 30. The ball valve 30 is provided with a spring retainer 32. As shown in the drawings, the spring retainer 32 is attached at one end to the ball valve 30. In FIG. 2, the other end of the spring retainer 32 is shown attached to the cylinder wall or head 34 of an engine (not shown) also shown in FIG. 2 is vibratory means 36 for effecting the vibration of the nozzle and the vibratory means preferably includes a piezoelectric crystal.

When the fuel injecton nozzle arrangement is inserted in a cylinder of an engine, for example as illustrated in FIG. 2, then the pressure in the cylinder and therefore on the outside of the nozzle 4 may exceed the internal fuel pressure in the nozzle. In the absence of the ball valve 30, this pressure could pass to the orifice 10 and force the ball valve 12 off its seat, thereby allowing gas to mix with the fuel in the swirl chamber 16. However, it will be appreciated that when the ball valve 30 is used, increased pressure in the combustion merely presses the ball valve 30 harder against its seat 28 and combustion gases cannot pass through the orifice 10. The spring 32 acts to ensure that the ball valve 30 returns to its seat 28 after vibration has stopped.

Figure 3:
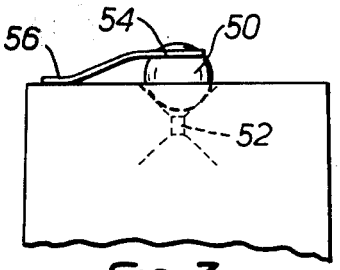
FIG. 3 shows a detail of a fuel injection nozzle tip.
Figure 4:
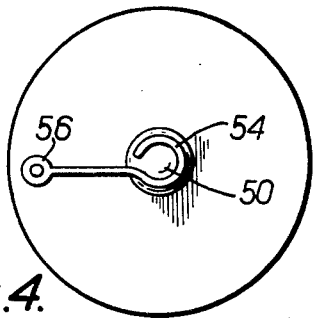
FIG. 4 is a plan view of the nozzle tip shown in FIG. 3.

Referring now to FIGS. 3 and 4, it will be seen that a ball valve 50 is arranged to block an orifice 52. A spring retainer 54 is attached at one end to the ball valve 50 by means of a circular arrangement shown most clearly in FIG. 4 and is attached at its other end to part of the nozzle tip at 56.

It is to be appreciated that the embodiments of the invention described above with reference to the drawings have been given by way of example only and that modifications may be effected. Thus, for example, other types of valve than a ball valve may be employed. The valve 30 can be made to be lighter than the valve 12, and various types of spring retainer can be used. Also, a coil or other spring can be provided in the swirl chamber 16 to help speedily force the ball valve 12 back to its valve seat 14 when the vibration of the nozzle is stopped.

What we claim is:

1. A fuel injection nozzle arrangement comprising a fuel injection nozzle having a fuel injecting orifice, and vibratory means for vibrating the nozzle to cause atomization of fuel ejected from the nozzle through the orifice, the nozzle having a fuel-retaining valve at the fuel inlet side of the orifice arranged to normally close the orifice and thus prevent the injection of fuel but to be opened when the vibratory means is energised to permit injection of fuel, and the nozzle having a gas-excluding valve at the fuel outlet side of the orifice arranged to normally close the orifice and thus prevent the entry of gases into the nozzle through the orifice but to open under fuel injection pressure to permit the injection of fuel, and the fuel retaining valve being situated in a housing in the nozzle and the housing having at least one aperture at a position where the valve will tend to move when the vibratory means is activated thereby to allow fuel to enter the housing through this aperture and force the fuel-retaining valve towards the orifice when the nozzle is not being vibrated.

2. A nozzle arrangement according to claim 1, in which the gas-excluding valve is arranged to normally close the orifice by means of a spring retainer.

3. A nozzle arrangement according to claim 2 in which the spring retainer is a leaf spring.

4. A nozzle arrangement according to claim 2, in which one end of the spring retainer is attached to the gas-excluding valve and the other end of the spring retainer is attached to means remote from the nozzle thereby to avoid increasing the mass of the nozzle.

5. A nozzle arrangement according to claim 1, in which the gas-excluding valve is a ball valve.

6. A nozzle arrangement according to claim 1, in which the vibratory means includes a piezoelectric crystal arrangement.

7. A nozzle arrangement according to claim 1 in which the housing also has fuel swirler slots, the fuel being able to enter the housing through these fuel swirler slots and being caused to swirl in the housing by the fuel swirler slots.

* * * * *